United States Patent [19]

Kaye

[11] 4,100,232

[45] Jul. 11, 1978

[54] CARBURETORS

[76] Inventor: Ronald Swynerton Kaye, 112 Kunyung Rd., Mt. Eliza, Victoria, 3930, Australia

[21] Appl. No.: 824,864

[22] Filed: Aug. 15, 1977

Related U.S. Application Data

[63] Continuation of Ser. No. 645,994, Jan. 2, 1976, abandoned.

[51] Int. Cl.[2] ..... F02M 5/12

[52] U.S. Cl. ..... 261/36 A; 137/38; 261/DIG. 50; 261/72 R

[58] Field of Search ..... 261/36 A, DIG. 50, 72 R; 137/38

[56] References Cited

U.S. PATENT DOCUMENTS

| | | | |
|---|---|---|---|
| 2,454,974 | 11/1948 | Mennesson | 261/DIG. 50 |
| 2,695,029 | 11/1954 | Bruegger | 261/36 A |
| 2,808,102 | 10/1957 | Lidecker | 261/36 A |
| 2,846,203 | 8/1958 | Voss et al. | 261/DIG. 50 |
| 2,998,056 | 8/1961 | Capehart | 261/36 A |
| 3,005,486 | 10/1961 | Donnell | 261/36 A |
| 3,020,030 | 2/1962 | Capehart | 261/DIG. 50 |
| 3,086,580 | 4/1963 | Capehart | 261/36 A |
| 3,162,235 | 12/1964 | Capehart | 261/DIG. 50 |
| 3,275,307 | 9/1966 | Robechand | 261/DIG. 50 |

FOREIGN PATENT DOCUMENTS

| | | | |
|---|---|---|---|
| 58,621 | 3/1974 | Australia | 261/36 A |

*Primary Examiner*—Tim R. Miles

*Attorney, Agent, or Firm*—Andrus, Sceales, Starke & Sawall

[57] ABSTRACT

The invention provides a carburetor comprising a float chamber, a throat and a fuel duct extending between the chamber and the throat and from which duct, subject to the below, fuel could overflow to the throat on tilting of the carburetor occurring; and wherein the carburetor is characterized in having a weir communicating, on one side, with the float chamber and, on the other side, with fuel collecting means and over which weir fuel can flow on such tilting occurring whereby to at least in part reduce overflow of fuel through said duct to the throat in consequence of such tilting.

The carburetor may be made such in initial manufacture or an existing carburetor may be modified.

A device for modifying a carburetor is also provided.

15 Claims, 12 Drawing Figures

CARBURETORS

This is a continuation application of Ser. No. 645,994, filed Jan. 2, 1976, now abandoned.

BACKGROUND OF THE INVENTION

Field of the Invention

This invention relates to carburetors.

In one aspect this invention relates to a novel carburetor and in another aspect it relates to a modified carburetor.

The invention also relates to a device and other apparatus for modifying a carburetor.

Further, the invention also relates to a fuel system.

Reference is made to Australian Pat. No. 446,468 and to U.S. patent application Ser. No. 553,827, now U.S. Pat. No. 4,044,746, and the whole of the subject matter of the specifications thereof is to be considered as imported hereinto. The device of the present invention may be used in conjunction with the devices of said patent and said application.

It has been observed with many carburetors that although float means therein will maintain fuel in a fuel bowl at a constant level in the region of the centre of gravity of the float means, tilting of the carburetor, such as may occur as a vehicle in which it is mounted ascends, or is stationary on a hill, can cause the fuel level in a discharge tube to a throat of the carburetor to rise to an extent that fuel overflows into the throat. This overflow may cause flooding, at least will probably make a fuel-air mixture delivered to an engine to be overrich and will almost certainly be wasteful of fuel.

In the case of vehicles having the fuel bowl mounted, respectively, forward of, to the side of, and to the rear of, the throat this overflow can occur on, respectively, going uphill, cornering, and going downhill.

Further, such overflow when it occurs in respect of a stationary vehicle parked on a hill can make restarting difficult.

It is an object of this invention to at least in part overcome the above problem.

SUMMARY OF THE INVENTION

The present invention provides a carburetor comprising a float chamber, a throat and a fuel duct extending between the chamber and the throat and from which duct, subject to the below, fuel could overflow to the throat on tilting of the carburetor occurring; and wherein the carburetor is characterized in having a weir communicating, on one side, with the float chamber and, on the other side, with fuel collecting means and over which weir fuel can flow on such tilting occurring whereby to at least in part reduce overflow of fuel through said duct to the throat in consequence of such tilting.

PREFERRED FEATURES OF THE INVENTION

It is preferred that the weir on said one side communicates directly with the float chamber.

In some constructions it might be possible for a siphon effect to be set up such that flow over the weir might continue and thereby drain the float chamber but if this was likely to occur it can simply be dealt with by incorporating an anti-siphon air vent above the weir.

The weir desirably is located as close to said duct as is possible but if the weir must be located to one side as will be usual it is preferred that it be to the left hand side for right hand drive cars and the right hand side for left hand drive.

Fuel passed to the fuel collecting means can be merely collected, can be returned to a fuel tank of a vehicle or can be returned to the inlet side of a fuel pump of a vehicle.

Since long lines may be necessary to pass fuel collected by the fuel collecting means to a fuel tank it is not considered very practical so to do.

On the other hand, if a line was run from the fuel collecting means to the inlet side of a fuel pump then it is likely that the pump would preferentially suck fuel and then air from the fuel collecting means and not from a fuel tank due to pressure differentials.

To at least in part overcome this last mentioned problem it is preferred to provide a collecting chamber having an outlet connected, in use, to the fuel pump on the intake side thereof, an inlet connected, in use to said fuel collecting means and valve means operative to open said outlet in response to the pressure within said collecting chamber of an amount of fuel in excess of a predetermined amount and to close said outlet in response to the presence within said collecting chamber of an amount of fuel less than a predetermined amount.

Said valve means preferably comprises a float which in an upper position opens said outlet and which in a lower position closes said outlet.

Said collecting chamber preferably also includes an air vent.

The carburetor as described above may be used in conjunction with devices in accordance with said patent and said application and if this is done it is preferred that the outlet thereof which, as described in said patent and said application is connected to the inlet side of the fuel pump, is connected instead to deliver to said collecting chamber.

The carburetor as described above may have the described features as a consequence of the initial manufacture of the carburetor in that the weir and the communications and, if desired, the anti-siphon air vent may be integrally formed with the carburetor. In this respect many existing carburetor designs would allow the inclusion of ducts therein in an initial moulding operation and which ducts could function as aforesaid. For instance, it would be possible to introduce cores which could be removed after moulding.

Alternatively, a carburetor in accordance with this invention may have the weir and the communications and, if desired, the anti-siphon air vent in consequence of modifying an existing carburetor.

Accordingly, in another aspect this invention provides a fuel regulating device comprising a weir, a passage adapted to be connected to a carburetor to communicate with a float chamber thereof; said duct being on one side of the weir and fuel collecting means on the other side of the weir and wherein the weir is positionable so that, on a tilting of the carburetor which would cause overflow of fuel from a fuel duct of, to the throat of, the carburetor, fuel can flow over the weir whereby to at least in part reduce overflow of fuel through said duct to the throat in consequence of such tilting.

The device preferably includes an anti-siphon air vent above the weir.

Said passage may be fitted with means adapted to be screwed into the body of the carburetor.

The device is preferably in combination with the above described collecting chamber and/or a device in accordance with said patent or said application.

This invention also provides a fuel system for a motor vehicle comprising a carburetor as above; and being either of such character in consequence of intitial manufacture or modification of an existing carburetor.

The system preferably also includes the collecting chamber as above.

The system preferably also includes a device in accordance with said patent or said application.

Specific non-limiting exemplification of this invention will now be given with the aid of the accompanying drawings.

DETAILED DESCRIPTION

Figure 1:
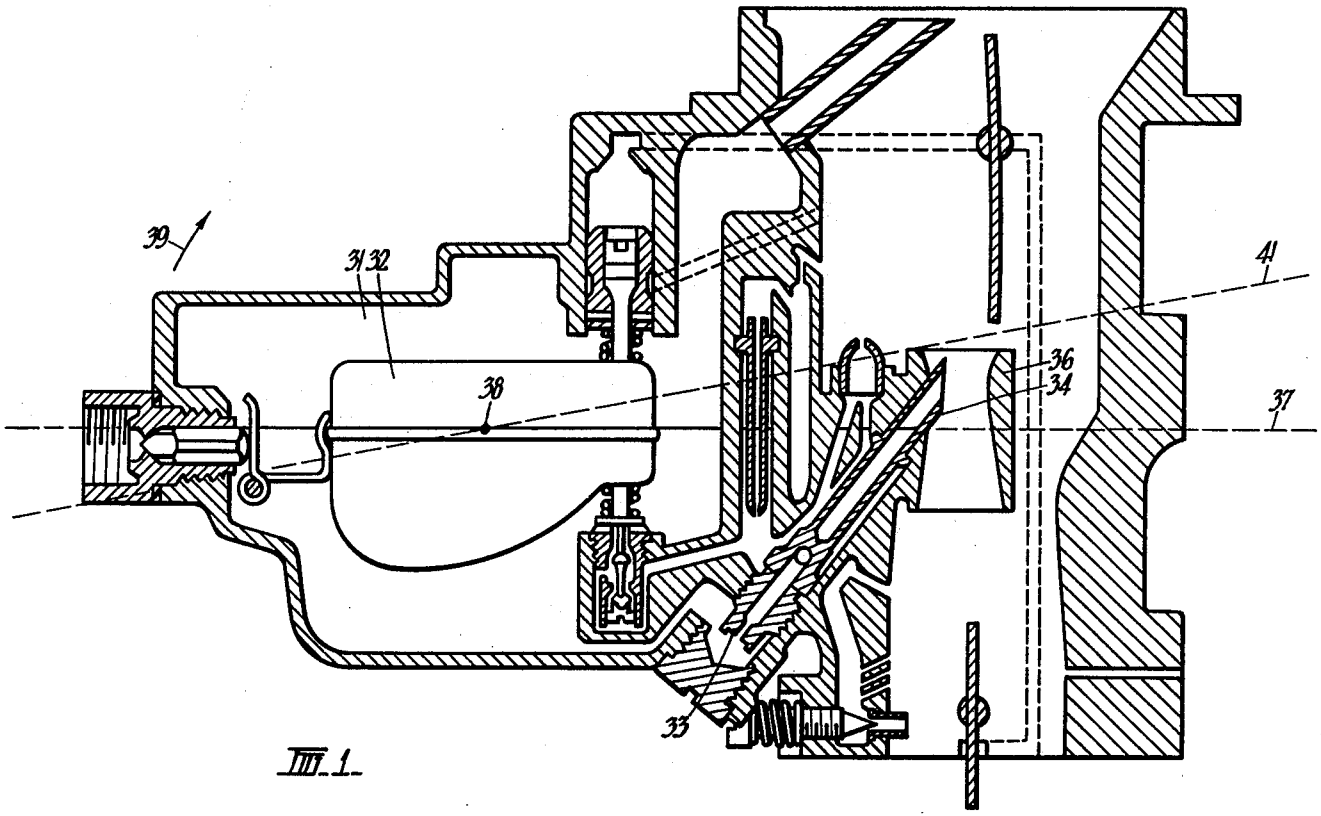
FIG. 1 is a cross-section of a known carburetor.

In FIG. 1 is shown a cross-section of a Stromberg carburetor of known type. Parts of that carburetor relevant to the present invention are a float chamber 31, a float 32, a main metering jet 33, a main discharge tube 34, a venturi 36, and the normal level of fuel when the carburetor is level indicated by dash line and reference numeral 37 which passes through the centre of gravity of the float 32.

It is to be noted that dash line 37 is shown passing through tube 34 but because fuel is being constantly drawn from tube 34 during operation of the carburetor the level therein will often be lower.

If the carburetor shown in FIG. 1 is tilted in the direction of arrow 39 until the dash line 41 represents a horizontal plane passing through the centre of gravity 38 the level of fuel will also be that line 41 and it will be observed that line 41 passes above the upper end of tube 34.

Thus under at least some conditions fuel can be expected to overflow from tube 34 to the venturi 36.

As stated, the actual level in tube 34 may well be below the level predicted but at least when a vehicle to which the carburetor is fitted is stationary on a hill and with its engine stopped and fuel is continued to be supplied to the carburetor due to residual pressure in a fuel pump, it can be expected that overflow will occur. Further, it is believed that on hills such overflow also commonly occurs when idling and that despite the withdrawal of fuel from tube 34 by the normal operation of the engine when ascending a hill some amount of overflow often occurs.

This overflow can be wasteful of fuel, produce an overrich mixture and can make starting difficult.

The present invention provides ways of at least in part reducing losses due to such overflow and does this by providing a weir over which fuel can flow to fuel collecting means.

The weir is desirably positioned as is most appropriate to a particular carburetor. In general the positioning of the weir will be at a horizontal level not substantially less than an opening in a fuel duct (usually the main fuel discharge tube) to the throat of a carburetor and preferably not more adjacent to a float chamber than is said opening.

In the following description various constructions able to at least in part reduce overflow losses will be explained.

Figure 2:
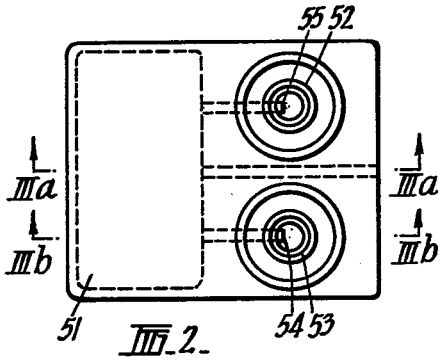
FIG. 2 is a top schematic plan of a twin throat carburetor showing how it might be constructed in accordance with this invention.
Figure 3A:
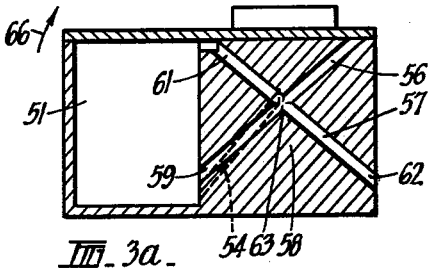
FIGS. 3*a* and 3*b* are cross-sections on lines III*a*—III*a* and III*b*—III*b* in FIG. 2.
Figure 3B:
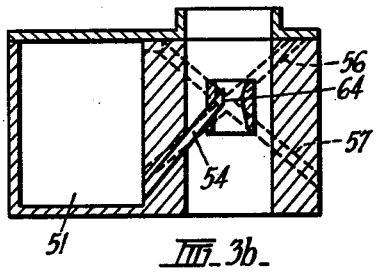

In FIGS. 2, 3*a* and 3*b* is shown a twin throat carburetor which has been constructed to have such a weir.

The carburetor of FIGS. 2, 3*a* and 3*b* comprises a float chamber 51, venturis 52 and 53 and main discharge tubes 54 and 55.

Two ducts 56 and 57 are provided in a partition wall 58 between the two throats. Those ducts are shown by dash lines in FIGS. 2 and 3*b* and by full lines in FIG. 3*a*.

The tube 54 is shown in dash line in FIG. 3*a* and by full lines in FIG. 3*b*.

The duct 56 communicates at its end 59 with the float chamber, and is blanked off at its opposite end which has no function and exists only in consequence of manufacturing operations.

The duct 57 at its end 61 constitutes an air vent and at its end 62 it constitutes an outlet.

That part of the wall 58 between ends 56 and 62 constitutes a weir having a "watershed" at 63.

It is to be noted that the lowermost point of the opening 64 from the tube 54 is slightly above watershed 63.

In use, fuel will flow through tubes 54 and 55 in usual manner and the fuel level will normally be below the watershed 63 but if the carburetor is tipped in the direction of arrow 66 fuel will at least in part instead of overflowing through opening 64 (and the corresponding opening of tube 56)pass over the watershed 63 of the weir to end 62 where the fuel may be collected and not be wasted.

The incorporation of the ducts 56 and 57 can be done by simply coring techniques in the manufacture of the carburetor and thus very little difficulty should be found in adapting this invention to the manufacture of carburetors.

In many instances, however, persons will desire to modify existing carburetors so as to take advantage of the present invention.

Figure 4:
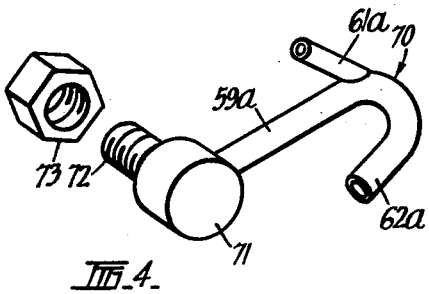
FIG. 4 is a perspective view of one device in accordance with this invention.
Figure 5:
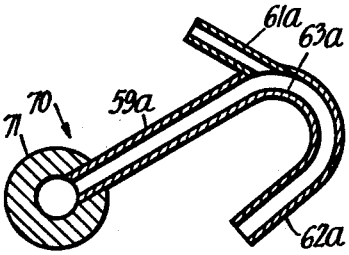
FIG. 5 is a cross-section through the device of FIG. 4.

To this end there is shown in FIGS. 4 and 5 a device 70 for use in modifying carburetors. Since parts thereof correspond in function, if not in actual nature, to parts of the carburetor shown in FIGS. 2, 3*a* and 3*b*, functionally equivalent parts bear the same reference numerals but distinguished where necessary by letters.

The device of FIGS. 4 and 5 comprises a hollow body 71 having a threaded sleeve 72 which can be passed through an aperture formed in the float chamber of a carburetor and which can be secured to the carburetor by a nut 73.

The body 71 has a tube connected thereto and communicating with the space therein. The tube comprises a part 59*a*, a part 62*a* and a watershed 63*a*. A further tube 61*a* is connected to the first mentioned tube.

Figure 8:
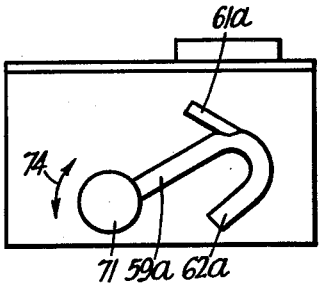
FIG. 8 is a schematic elevation showing the device of FIG. 4 attached to a carburetor.

In use, the device of FIGS. 4 and 5 is secured to a carburetor as shown in FIG. 8 and is rotated in the direction of arrows 74 until the watershed 63*a* is at the correct level.

The carburetor so modified will act in a similar way to the carburetor of FIGS. 2, 3*a* and 3*b* in that part 59*a* will convey fuel from the float chamber of the carburetor to the watershed 63*a* over which it may flow, if the carburetor is tilted, to part 62*a* and with tube 61*a* acting as an anti-siphon air vent.

Figure 6:
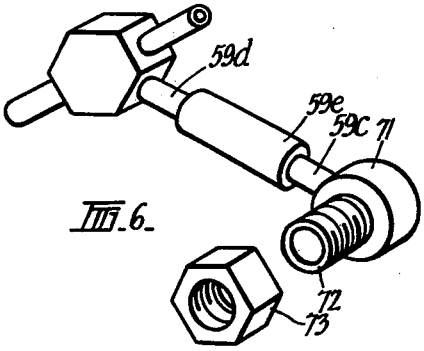
FIG. 6 is a perspective view of another device in accordance with this invention.
Figure 7:
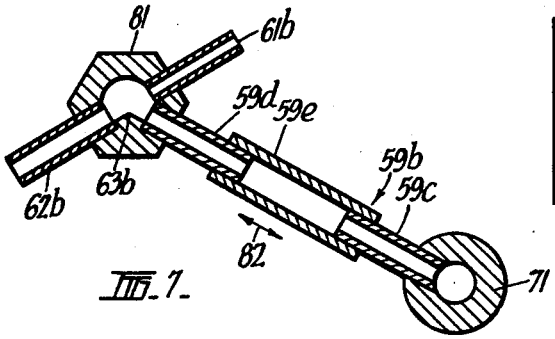
FIG. 7 is a cross-section through the device of FIG. 6.

The device of FIGS. 6 and 7 is similar to that of FIGS. 4 and 5 and like numerals denote like parts while parts different in form but functionally the same bear the same reference numerals but distinguished by letters.

The device of FIGS. 6 and 7 comprises a hollow body 71, a threaded sleeve 72 and a nut 73.

It further includes a tube 59*b* made up of parts 59*c* and 59*d* which are received within a sleeve 59*e*.

A hollow body 81 has part 59*d* connected thereto and has a tube 61*b*, a tube 62*b* and a watershed 63*b*.

The device of FIGS. 6 and 7 operates similarly to the device of FIGS. 4 and 5 but as well as being able to be rotated in similar manner as described with reference to arrows 74 in FIG. 8 the body 81 may be moved in the direction of arrows 82 by pushing parts 59*c* and 59*d* into, or withdrawing them from, sleeve 59*e*.

Figure 9:
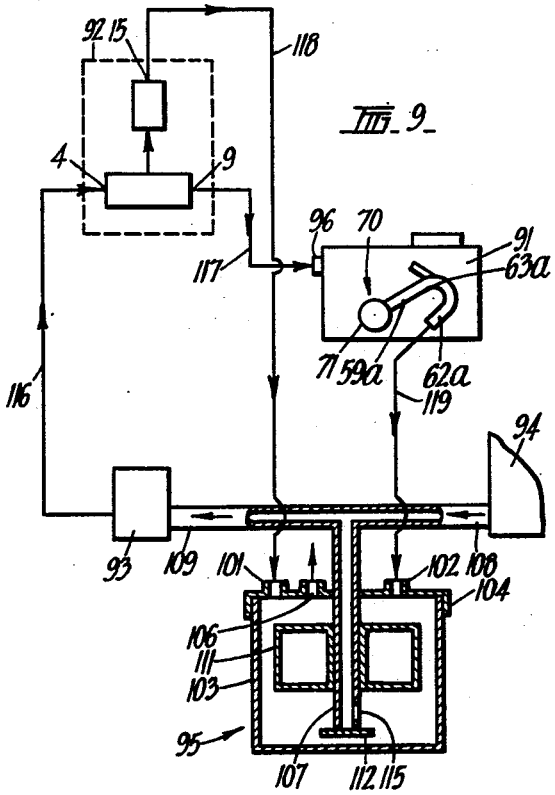
FIG. 9 is a schematic elevational representation of a fuel system.
Figure 10:
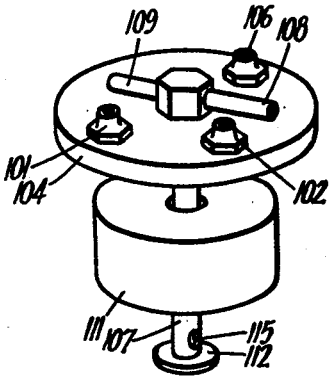
FIG. 10 is a detail of part of the fuel system shown in FIG. 9.

The use of the device of FIGS. 4 and 5 in a fuel system is illustrated in FIG. 9 with a detail being shown in FIG. 10.

The fuel system comprises a carburetor 91, the device 70, a fuel regulating device 92 in accordance with U.S. patent application Ser. No. 553,827, a fuel pump 93, a fuel tank 94 and a fuel collecting device 95.

The device 92 comprises an inlet 4, an outlet 9 which is connected to the inlet 96 of the carburetor, and an outlet 15 which, as used hitherto, has taken excess fuel directly back to the fuel pump 93. However, outlet 15 is connected to an inlet 101 of the device 95.

The part 62*a* is connected to another inlet 102 of the device 95.

The device 95 comprises a body 103, a closure cap 104, the aforesaid inlets 101 and 102 and an airvent 106. A tube 107 extends through the cap and forms a T-piece with lines 108 and 109 respectively from the fuel tank and to the fuel pump.

Mounted on the tube 107 is a float 111, a stop 112. The tube has an aperture 115 therein.

The operation of the above described fuel system will now be described from a commencing point in which the body 103 is empty of fuel.

As the body 103 is empty the float will rest on stop 112 and will close aperture 115.

When the fuel pump 93 applies suction to line 109 air will not be withdrawn in significant quantities from body 103 due to the closing of aperture 115 and instead fuel will be drawn from the fuel tank 94 via line 108 to the pump 93.

Fuel will be pumped by the pump via line 116 to the inlet 4 of the device 92. Fuel will pass therefrom out outlet 9 via line 117 to the inlet 96 and excess fuel will pass via outlet 15 and line 118 to inlet 101.

In the carburetor any overflow over the watershed 63*a* will pass via line 119 to inlet 102.

Fuel passed to inlets 102 and 102 will pass into the body 103 and will eventually cause float 111 to rise to uncover aperture 115.

At that stage the pump will preferentially suck fuel from body 103 via aperture 115, tube 107 and line 109 instead of from the fuel tank due to pressure differentials and restrictions on flow and thus a return to the commencing point is obtained with saving of fuel which might have been lost by overflow in the carburetor or due to excessive supply by the pump 93.

In a modification of the above the air vents 61*a* or 61*b* and 106 are connected to the air space above the fuel in the float chamber of the carburettor so as to comply with pollution law requirements.

Figure 11:
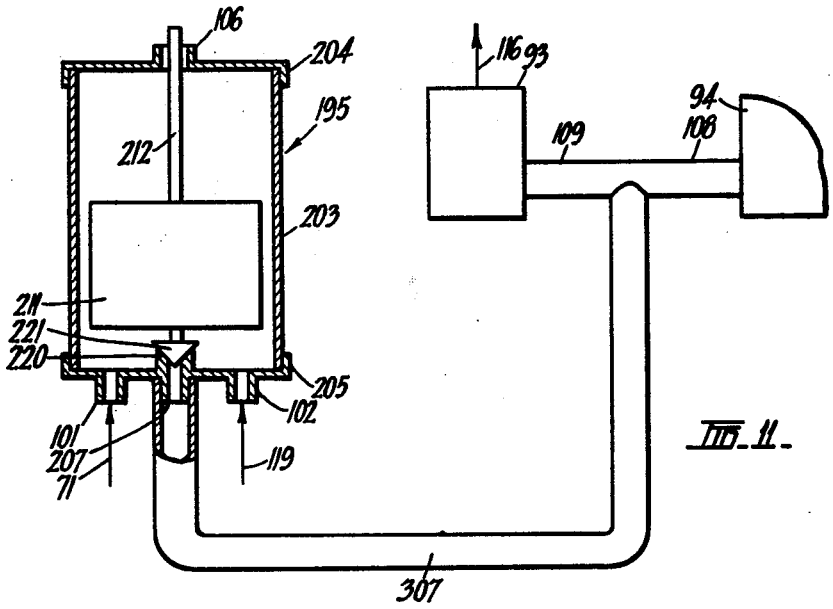
FIG. 11 is a schematic elevational representation, partly in cross section, of a fuel system.

The fuel system shown in FIG. 11 is similar to that of FIG. 9 and like reference numerals denote like parts. The principal difference is the fuel collecting device 195 which is used in lieu of device 95.

The device 195 comprises a body 203, end closures 204 and 205, inlets 101 and 102, air vent 106 and an outlet 207.

The outlet is connected to a tube 307 which forms a T-piece with lines 108 and 109 respectively from the fuel tank and to the fuel pump.

Within the body 203 is a float 211 having a stem 212 which passes through air vent 106 and outlet 207 and which serves to guide the float. Outlet 207 is provided with a seat 220 and a valve closure 221 is carried by the float.

Other connections are as in FIG. 9 excepting that air vent 106 and tube 61*a* are connected to an air space above the fuel level in the float chamber.

The device 195 operates in similar manner to device 95.

By use of this invention it has been found that significant quantities of fuel will flow over the weir provided and while it is readily conceded that such large quantities would probably not have overflowed within the carburetor actual road tests indicate a valuable saving of fuel nevertheless results.

Modifications and adaptions may be made to the above described without departing from the spirit and scope of this invention which includes every novel feature and combination of features disclosed herein.

The claims form part of the disclosure of this specification.

I claim:

1. A fuel regulating device for a carburetor having a float chamber for receiving fuel and a throat, said float chamber lying to one side of the throat in an imaginary vertical plane extending through said carburetor, a throat passage connected to said chamber and extending between the chamber and the throat and lying in said imaginary vertical plane, said passage having a nozzle for discharging fuel into the air stream passing through the throat, said chamber having a float for establishing fuel levels in said chamber and passage, said fuel regulating device being operative to prevent a discharge of fuel from said throat nozzle responsive to tilting to the carburettor in said imaginary vertical plane about an axis normal thereto which increases the fuel level in the throat passage, said fuel regulating device comprising:

a duct coupled to said carburettor and lying in a second imaginary vertical plane parallel to said first imaginary plane, said duct having an inlet end, an outlet end, and an intermediate portion; said inlet end communicating with the float chamber;

said outlet end forming a fuel discharge means for said duct; said intermediate portion forming a weir which is aligned with the nozzle of the throat passage in a direction normal to the vertical planes, the flow controlling portion of said weir being positioned below the opening of the nozzle for being responsive to increases in the level of fuel in the passage resulting from tilting the carburetor about said normal axis to pass fuel from said inlet end to said outlet end of said duct at an increased level of fuel in the throat passage less than that which causes a discharge of fuel from the throat nozzle.

2. A fuel regulating device as claimed in claim 1 including an anti-siphon air vent above the weir.

3. A fuel regulating device as claimed in claim 1 further including a fuel collecting means connected to the outlet end of said duct for receiving the fuel passed through said duct.

4. A fuel regulating device as claimed in claim 3 wherein said fuel collecting means has an outlet connectible to the inlet of a fuel pump for the carburetor and an inlet connected to said outlet end of said duct; said fuel collection means further including valve means operable to open said outlet of said fuel collection means in response to the presence, within said means, of an amount of fuel in excess of a predetermined amount and to close said outlet in response to the presence, within said means, of an amount of fuel less than the predetermined amount.

5. A fuel regulating device as claimed in claim 4, wherein said valve means comprises a float which, in an upper position opens said outlet and which, in a lower position, closes said outlet.

6. A fuel regulating device as claimed in claim 4 wherein said fuel collecting means includes an air vent.

7. A fuel regulating device as claimed in claim 4 further including means couplable to the output of said fuel pump and coupled to the inlet of said fuel collection means and to said carburetor for returning quantities of fuel not used by the carburetor to said fuel collection means.

8. A fuel regulating device as claimed in claim 1 wherein said weir and duct are integrally formed with the carburetor.

9. A fuel regulating device as claimed in claim 1 and wherein said weir and duct comprise a modifying element for an existing carburetor.

10. A fuel regulating device as claimed in claim 9 wherein said duct is provided with means adapted to be affixed to the body of the carburetor to communicate said duct with the float chamber and to mount the device to the carburetor.

11. A fuel system for a motor vehicle including the carburetor with a throat; a float chamber for receiving fuel lying to one side of the throat in an imaginary vertical plane extending through said carburetor; a throat passage connected to said float chamber and extending between the chamber and said throat and lying in said imaginary vertical plane, said passage having a nozzle for discharging fuel into the air stream passing through said throat, said chamber having a float for establishing fuel levels in said chamber and passage; and a duct lying in a second imaginary vertical plane parallel to said first imaginary plane, said duct having an inlet end, an outlet end, and an intermediate portion, said inlet end communicating with said float chamber, said outlet end forming a fuel discharge means, said intermediate portion forming a weir which is aligned with the nozzle of the throat passage in a direction normal to the vertical planes, the flow controlling portion of said weir being positioned below the opening of said nozzle for being responsive to increases in the level of fuel in the passage resulting from tilting the carburettor about an axis normal to said imaginary vertical planes to pass fuel from said inlet end to said outlet end of said duct at an increased level of fuel in said throat passage less than that which causes a discharge of fuel from said throat nozzle.

12. A fuel system as claimed in claim 11 including an anti-siphon air vent above the weir.

13. A fuel system as claimed in claim 11 having a fuel collection means connected to the outlet end of said duct.

14. A fuel system as claimed in claim 13 wherein the vehicle has a fuel pump for the carburetor and said fuel collection means has an outlet connectible to the inlet of the fuel pump and an inlet connected to said outlet end of said duct, said fuel collection means further including valve means operable to open said outlet of said fuel collection means in response to the presence, within said means, of an amount of fuel in excess of a predetermined amount and to close said outlet in response to the presence, within said means, of an amount of fuel less than a predetermined amount.

15. A fuel system for a motor vehicle as claimed in claim 14 further including means couplable to the output of said fuel pump and coupled to the inlet of said fuel collecction means and to said carburetor for returning quantities of fuel not used by the carburetor to said fuel collection means.

* * * * *